US012697699B2

(12) United States Patent
Ishii

(10) Patent No.: US 12,697,699 B2
(45) Date of Patent: Aug. 4, 2026

(54) RETAINER, TOP RING, AND SUBSTRATE PROCESSING APPARATUS

(71) Applicant: EBARA CORPORATION, Tokyo (JP)

(72) Inventor: Yu Ishii, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 430 days.

(21) Appl. No.: 18/268,082

(22) PCT Filed: Oct. 22, 2021

(86) PCT No.: PCT/JP2021/039069
§ 371 (c)(1),
(2) Date: Jun. 16, 2023

(87) PCT Pub. No.: WO2022/145117
PCT Pub. Date: Jul. 7, 2022

(65) Prior Publication Data

US 2024/0001506 A1 Jan. 4, 2024

(30) Foreign Application Priority Data

Dec. 28, 2020 (JP) ..... 2020-218340

(51) Int. Cl.
*B24B 37/32* (2012.01)

(52) U.S. Cl.
CPC ..... *B24B 37/32* (2013.01)

(58) Field of Classification Search
CPC ..... B24B 7/228; B24B 37/30; B24B 37/32; B24B 37/105; B24B 37/107; B24B 37/27; H01L 21/68721; H01L 21/30625
(Continued)

(56) References Cited

U.S. PATENT DOCUMENTS

2006/0160474 A1* 7/2006 Tseng ..... B24B 37/32 451/41
2014/0342643 A1* 11/2014 Yen ..... B24B 37/32 451/365
2020/0306924 A1 10/2020 Kobayashi et al.

FOREIGN PATENT DOCUMENTS

JP 2000-052242 A 2/2000
JP 2003048148 A * 2/2003 ..... B24B 37/042
(Continued)

OTHER PUBLICATIONS

Machine translation of JP-2003048148-A (Year: 2003).*
(Continued)

*Primary Examiner* — Robert F Neibaur
(74) *Attorney, Agent, or Firm* — BakerHostetler

(57) ABSTRACT

A retainer is disposed around a holding region 39 of a polygonal substrate WF in a top ring for holding the polygonal substrate WF with a surface to be polished facing downward. The retainer 30 includes a plurality of retainer main bodies 3 disposed around the holding region 39 independently along respective sides of the polygonal substrate WF. At least one of the plurality of retainer main bodies 3 includes a first securing surface (first surface 3*a*), a first opposed surface (second surface 3*b*), a second securing surface (third surface 3*c*), and a second opposed surface (fourth surface 3*d*). The first securing surface is securable to a retainer holding member 37 of the top ring, the first opposed surface is opposed to the holding region 39 in a first state where the first securing surface is secured to the retainer holding member 37, the second securing surface is securable to the retainer holding member 37 in a second state where the retainer main body 3 is rotated by 180 degrees from the first state, and the second opposed surface is opposed to the holding region 39 in a state where the second
(Continued)

securing surface is secured to the retainer holding member 37.

11 Claims, 10 Drawing Sheets

(58) Field of Classification Search
USPC ..... 451/41, 285, 286, 287, 398
See application file for complete search history.

(56) References Cited

FOREIGN PATENT DOCUMENTS

| | | | | | |
|---|---|---|---|---|---|
| JP | 2005-050893 | A | | 2/2005 | |
| JP | 3123851 | U | | 7/2006 | |
| JP | 2006297524 | A | * | 11/2006 | |
| JP | 2008137108 | A | * | 6/2008 | |
| JP | 2020-163529 | A | | 10/2020 | |
| KR | 2004-053313 | Y1 | | 4/2011 | |
| KR | 200453313 | Y1 | * | 4/2011 | ..... B24B 41/06 |

OTHER PUBLICATIONS

Machine translation of JP-2006297524-A (Year: 2006).*
Machine translation of JP-2008137108-A (Year: 2008).*
Machine translation of KR-200453313-Y1 (Year: 2011).*
International Patent Application No. PCT/JP2021/039069; Int'l Search Report; dated Dec. 21, 2021; 2 pages.

* cited by examiner

RETAINER, TOP RING, AND SUBSTRATE PROCESSING APPARATUS

CROSS-REFERENCE TO RELATED APPLICATIONS

This application is a U.S. national phase application of International Patent Application No. PCT/JP2021/039069 filed Oct. 22, 2021, which claims priority to Japanese Patent Application No. 2020-218340 filed Dec. 28, 2020, which are incorporated by reference in their entireties for any and all purposes.

TECHNICAL FIELD

This application relates to a retainer, a top ring, and a substrate processing apparatus. This application claims priority based on the Japanese patent application No. 2020-218340 filed on Dec. 28, 2020. The entire disclosure of the Japanese patent application No. 2020-218340, including the specification, the claims, the drawings, and the abstract is incorporated in this application by reference in its entirety.

BACKGROUND ART

There is a Chemical Mechanical Polishing (CMP) apparatus as a type of a substrate processing apparatus used in a semiconductor processing operation. The CMP apparatus can be roughly divided into a "face-up type (method where a surface to be polished of a substrate faces upward)" and a "face-down type (method where the surface to be polished of the substrate faces downward)" depending on a direction that the surface to be polished of the substrate faces.

The face-down type chemical mechanical polishing apparatus includes a top ring that holds a substrate and a polishing table on which a polishing pad is attached, and is configured to polish the substrate by pressing the substrate against the polishing pad while rotating the top ring and the polishing table. Here, the substrate comes off from the top ring to slip outside the top ring in some cases during polishing the substrate.

In contrast, for example, PTL 1 discloses a polishing apparatus that includes a retainer disposed around the substrate to prevent the substrate from slipping out while the top ring is rotating. This polishing apparatus prevents the substrate from slipping out by disposing the retainer and improves a polishing profile of the substrate by pressing the polishing pad with the retainer at the same time.

CITATION LIST

Patent Literature

PTL 1: Japanese Unexamined Patent Application Publication No. 2020-163529

SUMMARY OF INVENTION

Technical Problem

However, the technique described in PTL 1 does not consider reducing frequency of replacement of the retainer.

That is, although the retainer disposed around the substrate prevents the substrate from slipping outside the top ring, the substrate moves inside the top ring and collides against the retainer while the top ring is rotating in some cases. Especially in the case of the retainer disposed around a polygonal substrate, if a corner of the polygonal substrate collides against the retainer, a collided part becomes worn severely in some cases. As a result, the retainer possibly needs to be replaced frequently.

Therefore, one object of this application is to reduce a replacement frequency of the retainer.

Solution to Problem

According to one embodiment, a retainer is disclosed. The retainer is for being disposed around a holding region of a polygonal substrate in a top ring configured to hold and press the polygonal substrate toward a polishing pad and for being pressed toward the polishing pad. The retainer includes a plurality of retainer main bodies disposed around the holding region independently along respective sides of the polygonal substrate. At least one of the plurality of retainer main bodies includes a first securing surface, a first opposed surface, a second securing surface, and a second opposed surface, the first securing surface being securable to a retainer holding member of the top ring, the first opposed surface being opposed to the holding region in a first state where the first securing surface is secured to the retainer holding member, the second securing surface being securable to the retainer holding member in a second state where the retainer main body is rotated from the first state, the second opposed surface being opposed to the holding region in a state where the second securing surface is secured to the retainer holding member.

DESCRIPTION OF EMBODIMENTS

Figure 1:
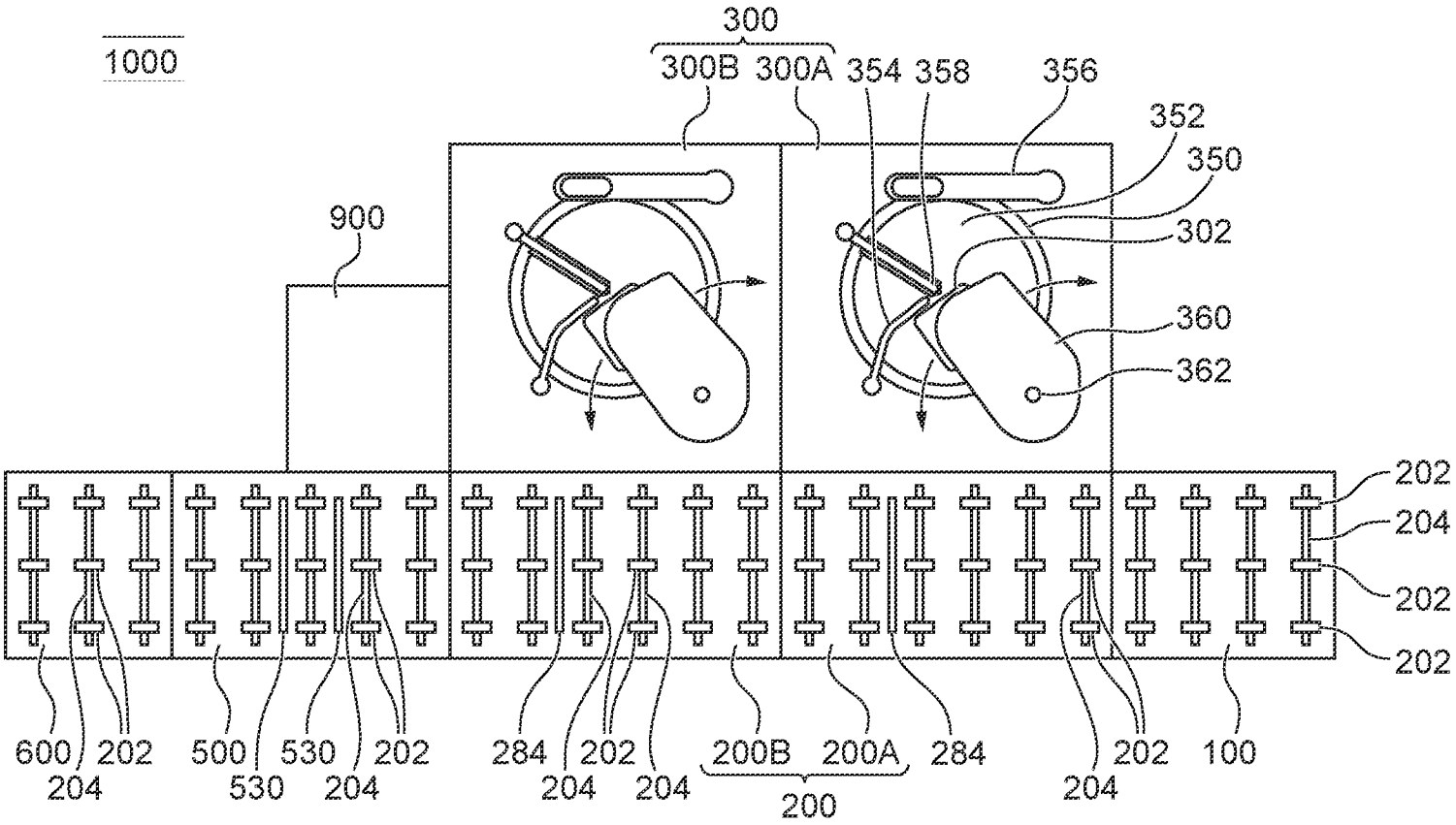
FIG. 1 is a plan view illustrating an overall configuration of a substrate processing apparatus according to one embodiment.

The following describes embodiments of a substrate processing apparatus according to the present invention with reference to the attached drawings. In the attached drawings, identical or similar reference numerals are attached to identical or similar components, and overlapping description regarding the identical or similar components may be omitted in the description of the respective embodiments. Features illustrated in the respective embodiments are applicable to other embodiments in so far as they are consistent with one another.

FIG. 1 is a plan view illustrating an overall configuration of a substrate processing apparatus 1000 according to one embodiment. The substrate processing apparatus 1000 illustrated in FIG. 1 includes a loading unit 100, a transfer unit 200, a polishing unit 300, a drying unit 500, and an unloading unit 600. In the illustrated embodiment, the transfer unit 200 includes two transfer units 200A and 200B, and the polishing unit 300 includes two polishing units 300A and 300B. In one embodiment, each of these units can be independently formed. Independently forming these units can easily form the substrate processing apparatus 1000 having a different configuration by conveniently combining the numbers of the respective units. The substrate processing apparatus 1000 also includes a control device 900, and the control device 900 controls each component of the substrate processing apparatus 1000. In one embodiment, the control device 900 can be configured of a general computer including, for example, an input and output device, an arithmetic device, and a storage device.

<Loading Unit>

The loading unit 100 is a unit for introducing a substrate WF before processing, such as polishing and cleaning, is performed into the substrate processing apparatus 1000. In one embodiment, the loading unit 100 is configured to comply with Mechanical Equipment Interface Standard (IPC-SMEMA-9851) of Surface Mount Equipment Manufacturers Association (SMEMA).

In the illustrated embodiment, a transfer mechanism of the loading unit 100 includes a plurality of transfer rollers 202 and a plurality of roller shafts 204 to which the transfer rollers 202 are mounted. In the embodiment illustrated in FIG. 1, each roller shaft 204 is mounted with three transfer rollers 202. The substrate WF is arranged on the transfer rollers 202, and the substrate WF is transferred as the transfer rollers 202 rotate. The installation positions of the transfer rollers 202 on the roller shafts 204 can be anywhere as long as the substrate WF can be stably transferred. However, since the transfer rollers 202 come into contact with the substrate WF, the transfer rollers 202 should be arranged such that the transfer rollers 202 come into contact with areas having no problem even if contacting the substrate WF as a process target. In one embodiment, the transfer rollers 202 of the loading unit 100 can be formed of a conductive polymer. In one embodiment, the transfer rollers 202 are electrically grounded via the roller shafts 204 and the like. This is for preventing an electronic device and the like on the substrate WF from getting damaged due to the electrically charged substrate WF. Additionally, in one embodiment, the loading unit 100 may be provided with an ionizer (not illustrated) for preventing the substrate WF from getting electrically charged.

<Transfer Unit>

The substrate processing apparatus 1000 illustrated in FIG. 1 includes the two transfer units 200A and 200B. Since the two transfer units 200A and 200B can have the same configuration, they will be described collectively as the transfer unit 200 below.

The illustrated transfer unit 200 includes the plurality of transfer rollers 202 for transferring the substrate WF. By rotating the transfer rollers 202, the substrate WF on the transfer rollers 202 can be transferred in a predetermined direction. The transfer rollers 202 of the transfer unit 200 may be formed of a conductive polymer or may be formed of a non-conductive polymer. The transfer rollers 202 are driven by a motor (not illustrated). The substrate WF is transferred to a substrate gripping or releasing position by the transfer rollers 202.

In one embodiment, the transfer unit 200 includes cleaning nozzles 284. The cleaning nozzle 284 is connected to a supply source of a cleaning liquid (not illustrated). The cleaning nozzle 284 is configured to supply the cleaning liquid to the substrate WF transferred by the transfer rollers 202.

<Drying Unit>

The drying unit 500 is a device for drying the substrate WF. In the substrate processing apparatus 1000 illustrated in FIG. 1, the drying unit 500 dries the substrate WF cleaned by a cleaner of the transfer unit 200 after being polished in the polishing unit 300. As illustrated in FIG. 1, the drying unit 500 is arranged at a downstream of the transfer unit 200.

The drying unit 500 includes a nozzle 530 for injecting a gas toward the substrate WF transferred on the transfer rollers 202. The gas can, for example, be compressed air or nitrogen. Blowing water droplets on the transferred substrate WF off by the drying unit 500 ensures drying the substrate WF.

<Unloading Unit>

The unloading unit 600 is a unit for unloading the substrate WF after having undergone the processes, such as polishing and cleaning, out of the substrate processing apparatus 1000. In the substrate processing apparatus 1000 illustrated in FIG. 1, the unloading unit 600 receives the substrate after being dried in the drying unit 500. As illustrated in FIG. 1, the unloading unit 600 is arranged at a downstream of the drying unit 500. In one embodiment, the unloading unit 600 is configured so as to comply with Mechanical Equipment Interface Standard (IPC-SMEMA-9851) of Surface Mount Equipment Manufacturers Association (SMEMA).

<Polishing Unit>

Figure 2:
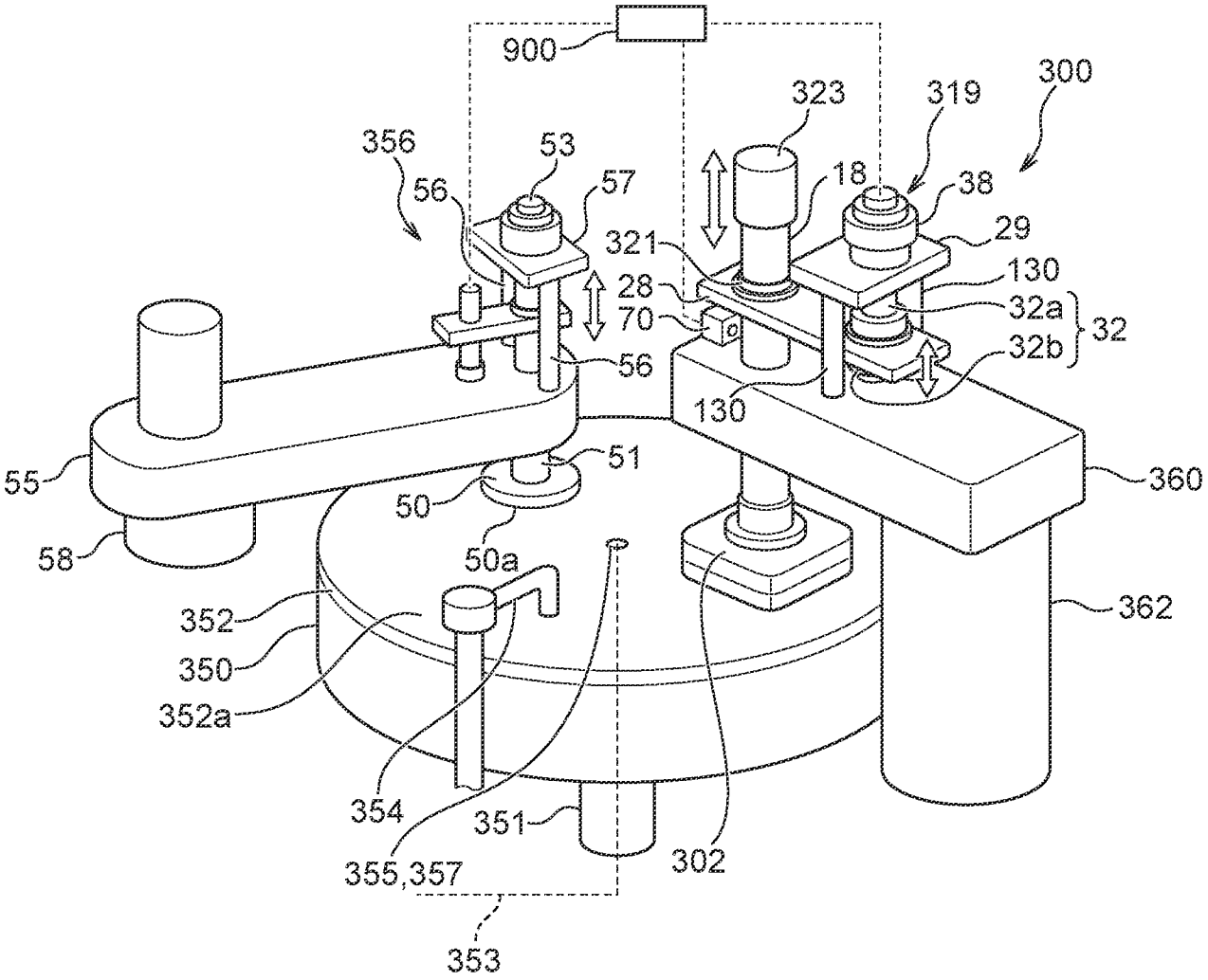
FIG. 2 is a perspective view schematically illustrating a configuration of a polishing unit according to one embodiment.

FIG. 2 is a perspective view schematically illustrating a configuration of the polishing unit 300 according to one embodiment. The substrate processing apparatus 1000 illustrated in FIG. 1 includes two polishing units 300A and 300B. Since the two polishing units 300A and 300B can have the same configuration, they will be described collectively as the polishing unit 300 below.

As illustrated in FIG. 2, the polishing unit 300 includes a polishing table 350 and a top ring 302 that holds and presses the substrate to be polished against a polishing surface on the polishing table 350. The polishing table 350 is coupled to a polishing table rotation motor (not illustrated), arranged below a table shaft 351, via the table shaft 351 and is rotatable around the table shaft 351. A polishing pad 352 is attached to an upper surface of the polishing table 350, and a surface 352*a* of the polishing pad 352 constitutes a polishing surface that polishes the substrate. In one embodiment, the polishing pad 352 may be attached via a layer for facilitating peeling from the polishing table 350. Such a layer includes, for example, a silicone layer or a fluorine-based resin layer, and for example, those described in Japanese Unexamined Patent Application Publication No. 2014-176950 may be used.

A polishing liquid supply nozzle 354 is installed above the polishing table 350, and the polishing liquid is supplied onto the polishing pad 352 on the polishing table 350 by the polishing liquid supply nozzle 354. Further, as illustrated in FIG. 2, the polishing table 350 and the table shaft 351 are provided with a passage 353 for supplying the polishing liquid. The passage 353 communicates with an opening portion 355 on the surface of the polishing table 350. A through-hole 357 is formed in the polishing pad 352 at the position corresponding to the opening portion 355 of the polishing table 350, and the polishing liquid passing through the passage 353 is supplied from the opening portion 355 of the polishing table 350 and the through-hole 357 of the polishing pad 352 to the surface of the polishing pad 352. Note that the numbers of the opening portion 355 of the polishing table 350 and the through-hole 357 of the polishing pad 352 may be single or plural. Further, although the positions of the opening portion 355 of the polishing table 350 and the through-hole 357 of the polishing pad 352 are any place, in one embodiment, they are arranged near the center of the polishing table 350.

Although not illustrated in FIG. 2, in one embodiment, the polishing unit 300 includes an atomizer 358 for injecting a liquid or a mixed fluid of a liquid and a gas toward the polishing pad 352 (see FIG. 1). The liquid injected from the atomizer 358 is, for example, pure water, and the gas is, for example, nitrogen gas.

The top ring 302 is connected to a top ring shaft 18, and the top ring shaft 18 moves vertically with respect to a swing arm 360 by an up-and-down motion mechanism 319. The vertical motion of the top ring shaft 18 causes the entire top ring 302 to move vertically with respect to the swing arm 360 for positioning. The top ring shaft 18 rotates by driving a top ring rotation motor (not illustrated). The rotation of the top ring shaft 18 causes the top ring 302 to rotate about the top ring shaft 18. Note that a rotary joint 323 is mounted to the upper end of the top ring shaft 18.

The top ring 302 can hold a quadrangular substrate on its lower surface with a surface to be polished facing downward. While a top ring that holds a substrate with the surface to be polished facing downward will be described in this embodiment, the top ring is not limited thereto. The swing arm 360 is configured to be turnable around a spindle 362. The top ring 302 can move between the substrate gripping or releasing position of the above-described transfer unit 200 and an upper side of the polishing table 350 by the turn of the swing arm 360. By moving the top ring shaft 18 down, the top ring 302 can be moved down to press the substrate against the surface (polishing surface) 352*a* of the polishing pad 352. At this time, the top ring 302 and the polishing table 350 are each rotated, and the polishing liquid is supplied from the polishing liquid supply nozzle 354 disposed above the polishing table 350 and/or from the opening portion 355 disposed in the polishing table 350 onto the polishing pad 352. Thus, by pressing the substrate WF against the polishing surface 352*a* of the polishing pad 352, the surface of the substrate can be polished. During polishing of the substrate WF, the arm 360 may be fixed or swung such that the top ring 302 passes through the center of the polishing pad 352 (so as to cover the through-hole 357 of the polishing pad 352).

The up-and-down motion mechanism 319, which vertically moves the top ring shaft 18 and the top ring 302, includes a bridge 28 that rotatably supports the top ring shaft 18 via a bearing 321, a ball screw 32 mounted to the bridge 28, a support table 29 supported by a support pillar 130, and a servo motor 38 disposed on the support table 29. The support table 29 that supports the servo motor 38 is secured to the swing arm 360 via the support pillar 130.

The ball screw 32 includes a screw shaft 32*a* coupled to the servo motor 38 and a nut 32*b* into which the screw shaft 32*a* is screwed. The top ring shaft 18 vertically moves integrally with the bridge 28. Therefore, when the servo motor 38 is driven, the bridge 28 vertically moves via the ball screw 32, whereby the top ring shaft 18 and the top ring 302 vertically move. The polishing unit 300 includes a ranging sensor 70 as a position detecting module for detecting a distance to a lower surface of the bridge 28, that is, the position of the bridge 28. By detecting the position of the bridge 28 with the ranging sensor 70, the position of the top ring 302 can be detected. The ranging sensor 70 constitutes the up-and-down motion mechanism 319 together with the ball screw 32 and the servo motor 38. Note that the ranging sensor 70 may be a laser type sensor, an ultrasonic sensor, an overcurrent type sensor, or a linear scale type sensor. Further, each equipment in the polishing unit including the ranging sensor 70 and the servo motor 38 is configured to be controlled by the control device 900.

The polishing unit 300 according to one embodiment includes a dressing unit 356 that dresses the polishing surface 352*a* of the polishing pad 352. As illustrated in FIG. 2, the dressing unit 356 includes a dresser 50, a dresser shaft 51, an air cylinder 53, and a swing arm 55. The dresser 50 is brought into sliding contact with the polishing surface 352*a*. The dresser 50 is coupled to the dresser shaft 51. The air cylinder 53 drives the dresser shaft 51 up and down. The swing arm 55 rotatably supports the dresser shaft 51. A dressing member 50*a* is held onto the lower portion of the dresser 50, and needle-shaped diamond particles are electrodeposited to a lower surface of the dressing member 50*a*. The air cylinder 53 is disposed on a support table 57 supported by support pillars 56, and the support pillars 56 are secured to the swing arm 55.

The swing arm 55 is configured to be driven by a motor (not illustrated) to turn about a spindle 58. The dresser shaft 51 is disposed to be opposed to the polishing pad 352 and rotated by the driving of a motor not illustrated in FIG. 2, and the dresser 50 is rotated about the dresser shaft 51 by the rotation of the dresser shaft 51. The air cylinder 53 vertically moves the dresser 50 via the dresser shaft 51, and presses the dresser 50 against the polishing surface 352*a* of the polishing pad 352 with a predetermined pressing force.

The dressing of the polishing surface 352*a* of the polishing pad 352 is performed as follows. The dresser 50 is pressed against the polishing surface 352*a* by the air cylinder 53, and the pure water is simultaneously supplied to the polishing surface 352*a* from a pure water supply nozzle (not illustrated). In this state, the dresser 50 rotates about the dresser shaft 51 to bring the lower surface (diamond particles) of the dressing member 50*a* into sliding contact with the polishing surface 352*a*. Thus, the dresser 50 scrapes off the polishing pad 352 to dress the polishing surface 352*a*.

Figure 3:
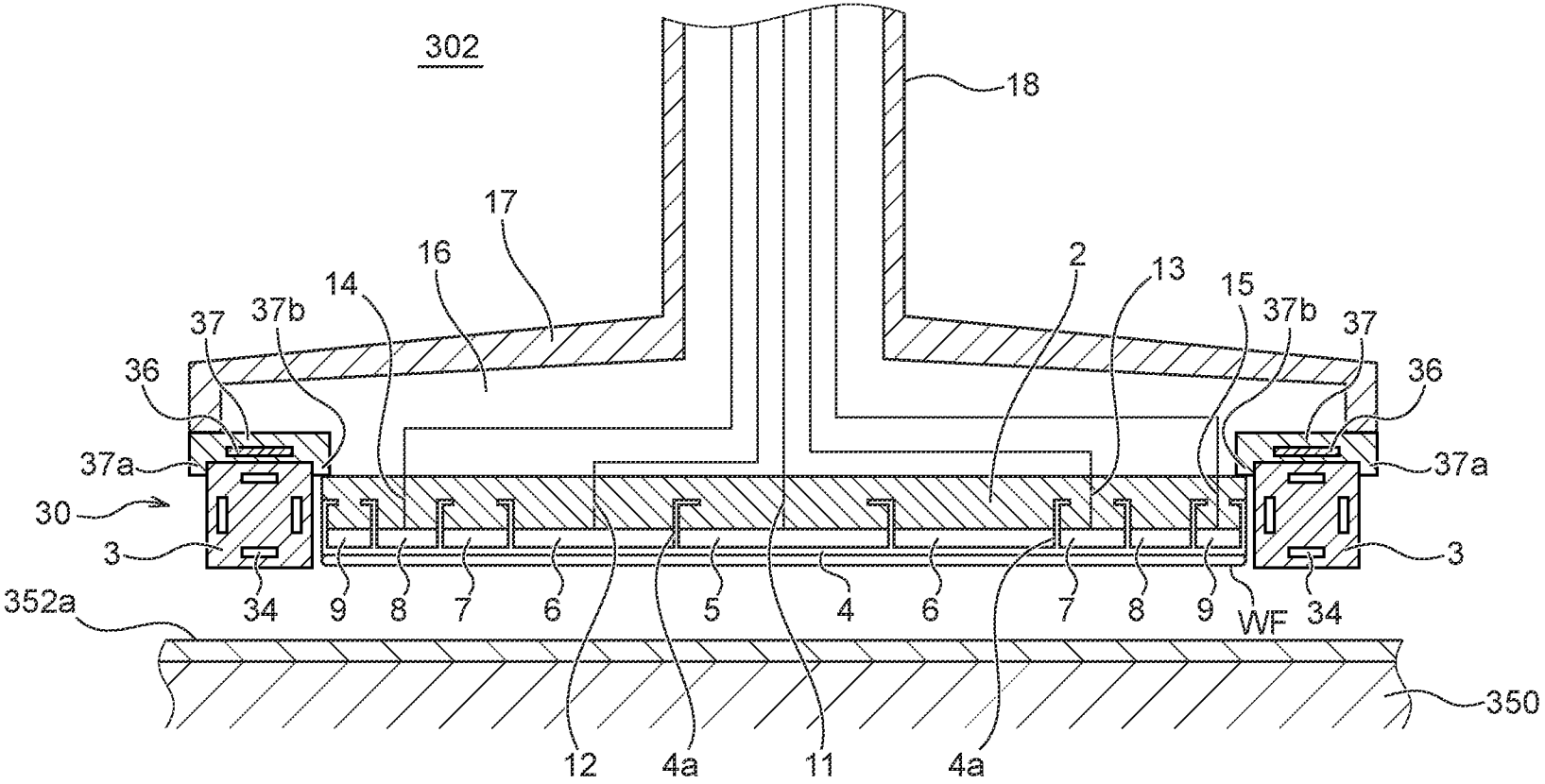
FIG. 3 is a schematic cross-sectional view of a top ring according to one embodiment.

Next, the top ring 302 in the polishing unit 300 according to one embodiment will be described. FIG. 3 is a schematic cross-sectional view of the top ring 302 according to one embodiment. In FIG. 3, only main components constituting the top ring 302 are schematically illustrated. While this embodiment shows an example in which the top ring 302 holds a quadrangular substrate on its lower surface, the top ring 302 can hold a polygonal substrate not limited thereto.

As shown in FIG. 3, the top ring 302 includes a flange 17 attached to the top ring shaft 18 and retainer holding members 37 attached to a lower surface of an outer peripheral portion of the flange 17. Further, the top ring 302 includes a main body 2 that presses the substrate WF against the polishing surface 352*a* and a retainer 30 disposed around the substrate WF (holding region of the substrate WF) held by the top ring 302. The main body 2 is formed of a roughly quadrangle flat plate-shaped member, and the retainer 30 is disposed outside the main body 2. In one embodiment, the retainer 30 is configured to be pressed toward the polishing pad 352 (polishing surface 352*a*). The retainer 30 includes a plurality of (four in this embodiment) retainer main bodies 3 disposed around the holding region of the substrate WF independently along four sides of the substrate WF. Each of the retainer main bodies 3 is an elongate rod-shaped member. Each of the retainer main bodies 3 is secured to the retainer holding member 37.

The main body 2 is made of a metal such as a stainless steel (SUS) or a resin such as an engineering plastic (for example, PEEK). The main body 2 has a lower surface on which an elastic film (membrane) 4 that contacts a back surface of the substrate is mounted. In one embodiment, the elastic film (membrane) 4 is made of a rubber material having excellent strength and durability such as an ethylene propylene rubber (EPDM), a polyurethane rubber, and a silicon rubber. In one embodiment, the elastic film (membrane) 4 can be made of the rubber material using a mold. The main body 2 may be configured by combining a plurality of members.

As illustrated in FIG. 3, the elastic film (membrane) 4 includes a plurality of concentric partition walls 4*a*. These partition walls 4*a* form a circular center chamber 5, a quadrangle annular ripple chamber 6 surrounding the center chamber 5, a quadrangle annular middle chamber 7 surrounding the ripple chamber 6, a quadrangle annular outer chamber 8 surrounding the middle chamber 7, and a quadrangle annular edge chamber 9 surrounding the outer chamber 8 between an upper surface of the elastic film 4 and the lower surface of the main body 2. That is, the center chamber 5 is formed on a center portion of the main body 2, and the ripple chamber 6, the middle chamber 7, the outer chamber 8, and the edge chamber 9 are concentrically formed sequentially from the center in an outer peripheral direction. As illustrated in FIG. 3, the main body 2 internally includes a flow passage 11 communicated with the center chamber 5, a flow passage 12 communicated with the ripple chamber 6, a flow passage 13 communicated with the middle chamber 7, a flow passage 14 communicated with the outer chamber 8, and a flow passage 15 communicated with the edge chamber 9, respectively. The flow passage 11 communicated with the center chamber 5, the flow passage 12 communicated with the ripple chamber 6, the flow passage 13 communicated with the middle chamber 7, the flow passage 14 communicated with the outer chamber 8, and the flow passage 15 communicated with the edge chamber 9 are connected to a fluid supply source and a vacuum source via a rotary joint (not illustrated).

In the top ring 302 configured as illustrated in FIG. 3, it is possible to independently adjust respective pressures of fluid supplied to the center chamber 5, the ripple chamber 6, the middle chamber 7, the outer chamber 8, and the edge chamber 9. With such a structure, a pressing force for pressing the substrate WF against the polishing pad 352 can be adjusted for each region of the substrate WF. The elastic film 4 is provided with a plurality of vacuum suction holes, and the substrate WF can be vacuum suctioned to the top ring 302 by a vacuum source.

Next, the detail of the retainer main body 3 and the retainer holding member 37 will be described. While the retainer 30 of this embodiment includes four retainer main bodies 3, only one retainer main body 3 will be described since they all have the same configuration. However, the four retainer main bodies 3 need not have the same configuration, and at least one of the four retainer main bodies 3 may have the configuration described below.

Figure 4A:
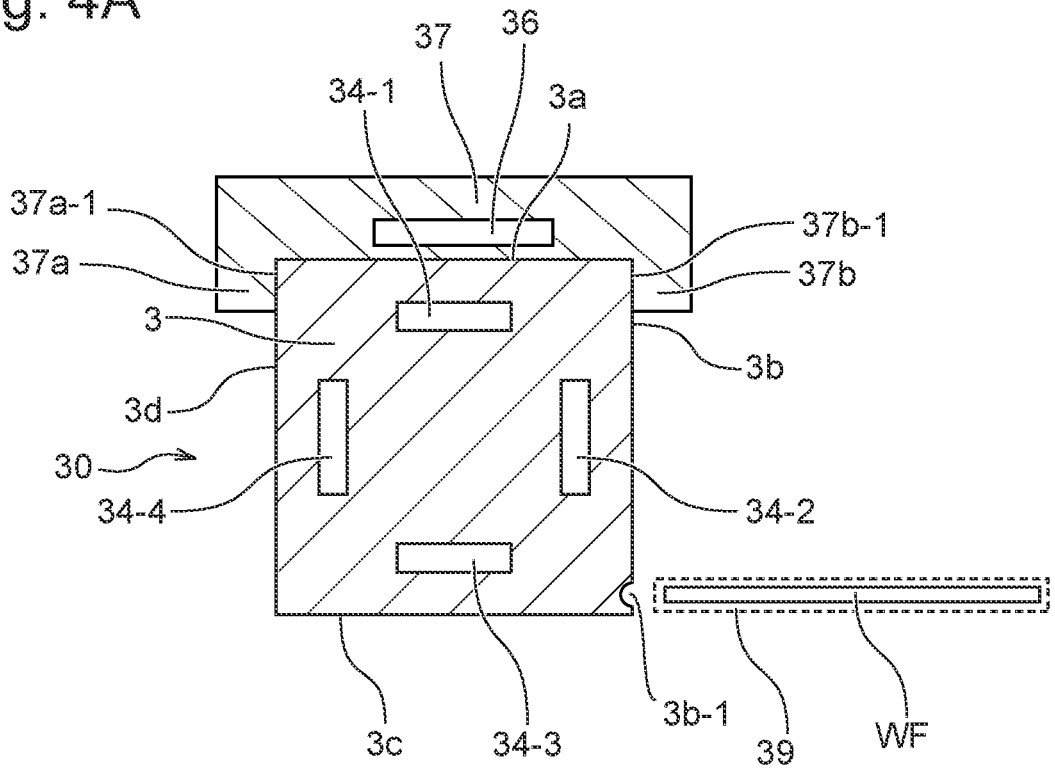
FIG. 4A is a cross-sectional view illustrating a first state where a retainer main body is secured to a retainer holding member.
Figure 5A:
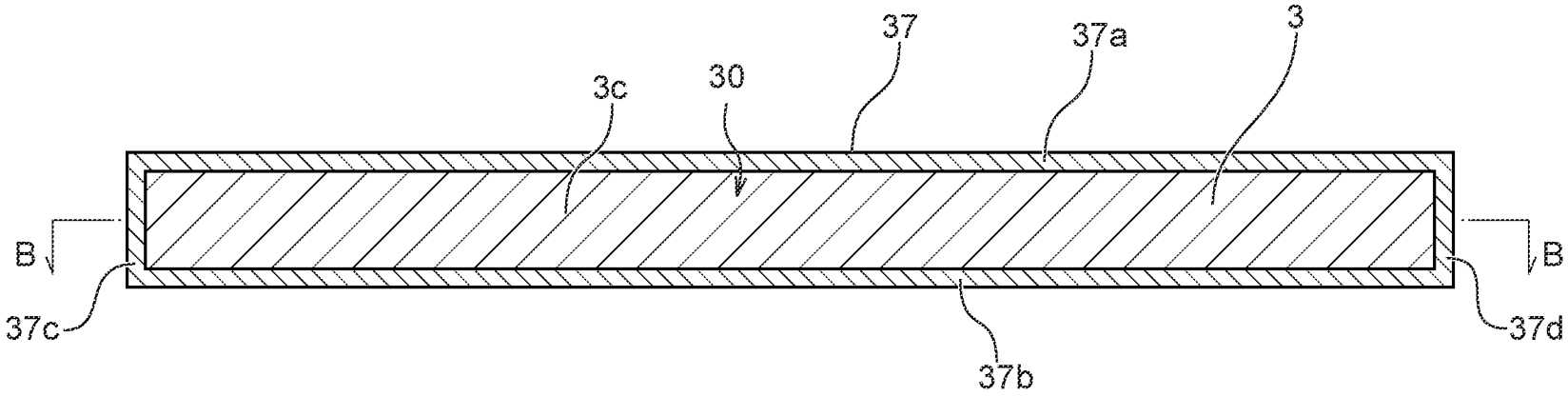
FIG. 5A is a bottom view of the retainer main body and the retainer holding member in FIG. 4A.
Figure 5B:
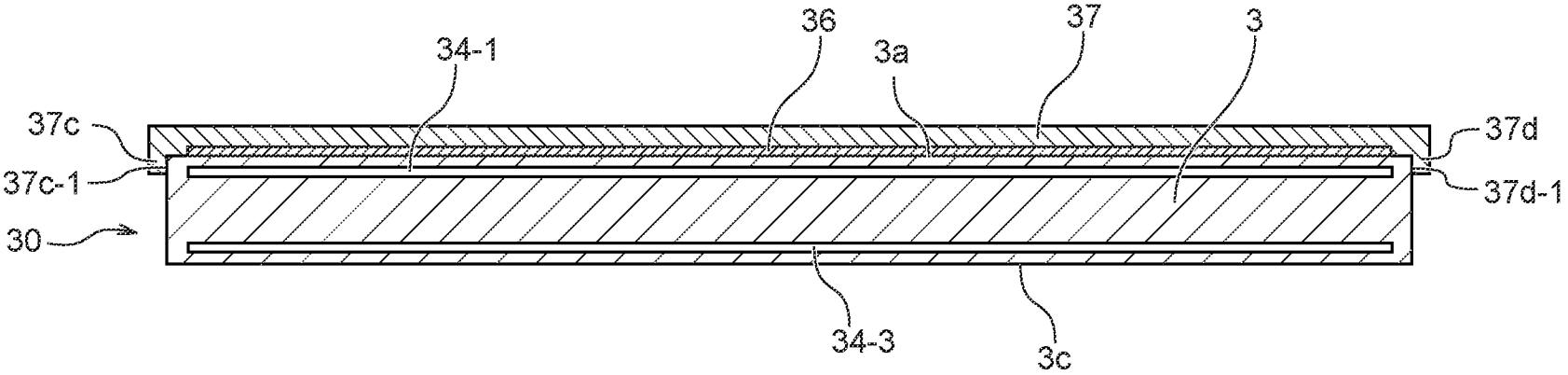
FIG. 5B is a cross-sectional view of the retainer main body and the retainer holding member taken along the line B-B in FIG. 5A.

FIG. 4A is a cross-sectional view illustrating a first state where the retainer main body is secured to the retainer holding member. FIG. 5A is a bottom view of the retainer main body and the retainer holding member in FIG. 4A. FIG. 5B is a cross-sectional view of the retainer main body and the retainer holding member taken along the line B-B in FIG. 5A. The retainer main body 3 of this embodiment has a square prism shape, and as illustrated in FIG. 4A, the retainer main body 3 has a square cross-sectional shape perpendicular to an extending direction.

As illustrated in FIG. 4A, the retainer main body 3 has a first surface (first securing surface) 3*a* that is securable to the retainer holding member 37. The retainer main body 3 has a second surface (first opposed surface) 3*b* opposed to a holding region 39 of the substrate WF in the first state where the first surface 3*a* is secured to the retainer holding member 37. The second surface 3*b* has an opposed portion 3*b*-1 opposed to the holding region 39. The retainer main body 3 includes a first magnetic member 34-1 embedded in the first surface 3*a* to secure the first surface 3*a* to the retainer holding member 37. On the other hand, the retainer holding member 37 includes a magnet 36 disposed on an opposed surface opposed to the retainer main body 3. The first surface 3*a* is secured to the retainer holding member 37 by the first magnetic member 34-1 and the magnet 36 attracting each other.

A rectangular depression for fitting the retainer main body 3 is formed on a bottom surface of the retainer holding member 37, and side walls 37*a*, 37*b*, 37*c*, and 37*d* are formed around the depression. The side wall 37*a* of the retainer holding member 37 includes a first abutting surface 37*a*-1 abutting on a fourth surface 3*d* of the retainer main body 3. This inhibits the retainer main body 3 from displacing in a direction separating from the holding region 39. The side wall 37*b* of the retainer holding member 37 includes a second abutting surface 37*b*-1 abutting on the second surface 3*b* of the retainer main body 3. This inhibits the retainer main body 3 from displacing in a direction approaching the holding region 39. Furthermore, the side walls 37*c* and 37*d* of the retainer holding member 37 include a third abutting surface 37*c*-1 and a fourth abutting surface 37*d*-1 abutting on each bottom surface of the retainer main body 3. This inhibits the retainer main body 3 from displacing in the extending direction.

When the substrate WF is polished in the first state where the retainer main body 3 is secured to the retainer holding member 37, the substrate WF moves inside the top ring 302 in association with a rotation of the top ring 302. Then, side surfaces and corners of the quadrangular substrate WF collide against the opposed portion 3*b*-1 at a lower part of the second surface 3*b* of the retainer main body 3, and the opposed portion 3*b*-1 at a lower part of the second surface 3*b* becomes worn (FIG. 4A illustrates a state where the opposed portion 3*b*-1 is worn and recessed approximately parallel to the holding region 39.). However, the retainer 30 of this the embodiment can be continuously used by rotating (changing the orientation of) the retainer main body 3 when the opposed portion 3*b*-1 exceeds a wear limit, thus reducing a replacement frequency of the retainer 30. This respect will be described below.

Figure 4B:
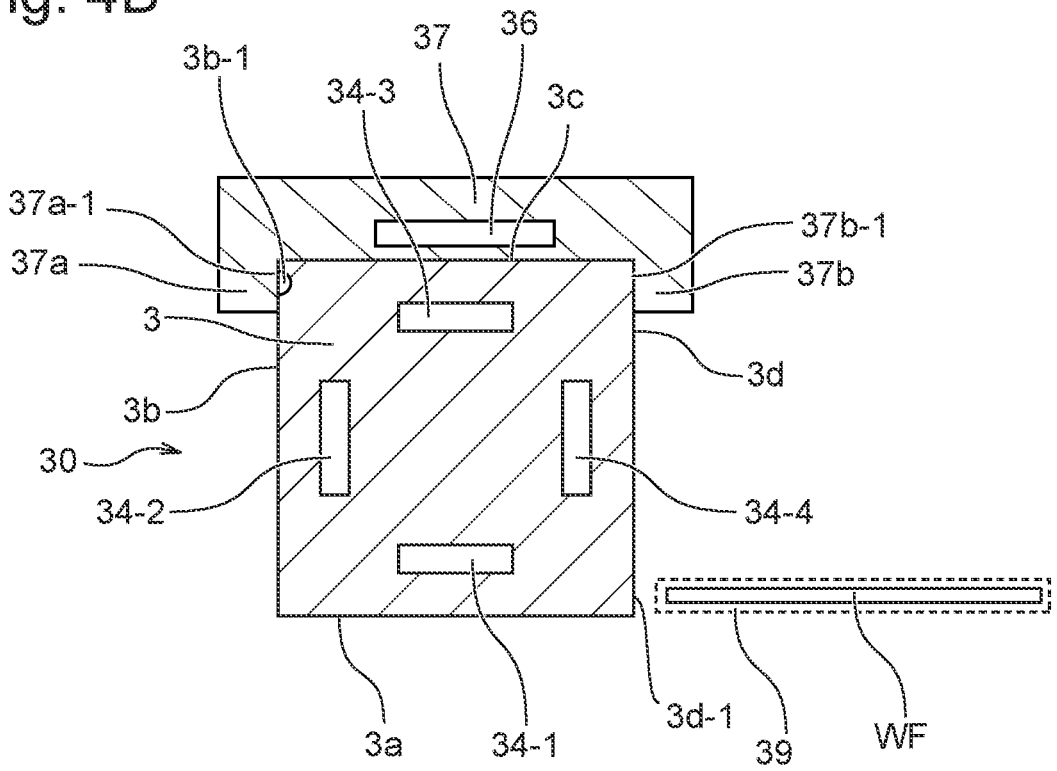
FIG. 4B is a cross-sectional view illustrating a second state where the retainer main body is secured to the retainer holding member.

FIG. 4B is a cross-sectional view illustrating a second state where the retainer main body is secured to the retainer holding member. The second state is a state where the retainer main body 3 is rotated by 180 degrees about a virtual rotation axis along the extending direction of the retainer main body 3. As illustrated in FIG. 4B, the retainer main body 3 has a third surface (second securing surface) 3*c* different from the first surface (first securing surface) 3*a* and the fourth surface (second opposed surface) 3*d* different from the second surface 3*b*. In the second state, the third surface 3*c* is securable to the retainer holding member 37, and the fourth surface 3*d* is opposed to the holding region 39 in a state where the third surface 3*c* is secured to the retainer holding member 37. The fourth surface 3*d* has an opposed portion 3*d*-1 opposed to the holding region 39. The retainer main body 3 includes a third magnetic member 34-3 embedded in the third surface 3*c* to secure the third surface 3*c* to the retainer holding member 37. The third surface 3*c* is secured to the retainer holding member 37 by the third magnetic member 34-3 and the magnet 36 attracting each other.

When the substrate WF is polished in the second state where the retainer main body 3 is secured to the retainer holding member 37, the substrate WF moves inside the top ring 302 in association with the rotation of the top ring 302. However, the substrate WF collides against the fourth surface 3*d* that has not become worn, instead of the second surface 3*b* that has already become worn. Accordingly, the retainer main body 3 can be continuously used after the second surface 3*b* becomes worn.

While the above-described embodiment shows the example in which the retainer main body 3 is rotated by 180 degrees about the virtual rotation axis along the extending direction of the retainer main body 3, the configuration is not limited thereto, and the retainer main body 3 may be rotated by 90 degrees or may be rotated by 270 degrees about the virtual rotation axis. That is, the retainer main body 3 includes a second magnetic member 34-2 embedded in the second surface 3*b* and a fourth magnetic member 34-4 embedded in the fourth surface 3*d*. Accordingly, the retainer main body 3 is securable to the retainer holding member 37 in each state where the retainer main body 3 is rotated by 90 degrees and 270 degrees from the first state. Since a surface opposed to the holding region 39 (surface that becomes worn by collision against the substrate WF) is different in each state, the retainer main body 3 can be continuously used without being replaced.

The retainer main body 3 may be rotated such that the extending direction of the retainer main body 3 is switched, instead of rotating the retainer main body 3 about the virtual rotation axis along the extending direction of the retainer main body 3 as described above. The orientation of the retainer main body 3 may be changed in a combination of these two ways of rotation.

Figure 4C:
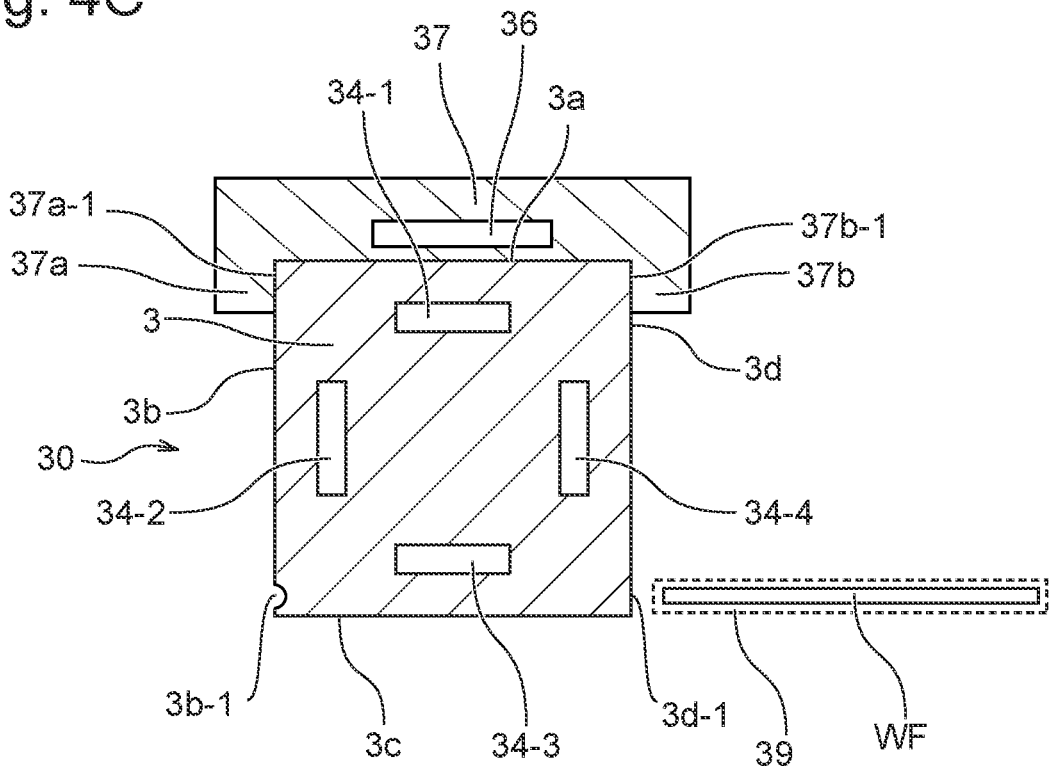
FIG. 4C is a cross-sectional view illustrating a third state where the retainer main body is secured to the retainer holding member.

FIG. 4C is a cross-sectional view illustrating a third state where the retainer main body is secured to the retainer holding member. The third state is a state where the retainer main body 3 is rotated such that the extending direction of the retainer main body 3 is switched in a horizontal plane from the above-described first state to secure the retainer main body 3 to the retainer holding member 37. As illustrated in FIG. 4C, the retainer main body 3 includes the first surface 3*a* that is securable to the retainer holding member 37 and the fourth surface (opposed surface) 3*d* different from the second surface 3*b*. The fourth surface 3*d* is opposed to the holding region 39 in the state where the first surface 3*a* is secured to the retainer holding member 37. When the extending direction of the retainer main body 3 is thus switched in the horizontal plane, a surface secured to the retainer holding member 37 is the same as that in the first state, while a surface opposed to the holding region 39 is different from that in the first state. Accordingly, the retainer main body 3 can be continuously used.

In each state where the retainer main body 3 is rotated by 90 degrees, 180 degrees, and 270 degrees about the virtual rotation axis along the extending direction of the retainer main body 3 from the third state, the retainer main body 3 is still securable to the retainer holding member 37, and further, can be continuously used since it has a different opposed portion opposed to the holding region 39. That is, in the example of FIG. 4B, the second opposed surface (fourth surface 3*d*) of the retainer main body 3 in the second state is different from the first opposed surface (second surface 3*b*) of the retainer main body 3 in the first state. On the other hand, the second opposed surface of the retainer main body 3 in the second state is a surface that is the same as the first opposed surface in some cases. In this case, the second opposed surface is a surface having an opposed portion opposed to the holding region 39 that is different from the opposed portion opposed to the holding region 39 in the first state. The following describes an example in which the second opposed surface is the same as the first opposed surface as a fourth state.

Figure 4D:
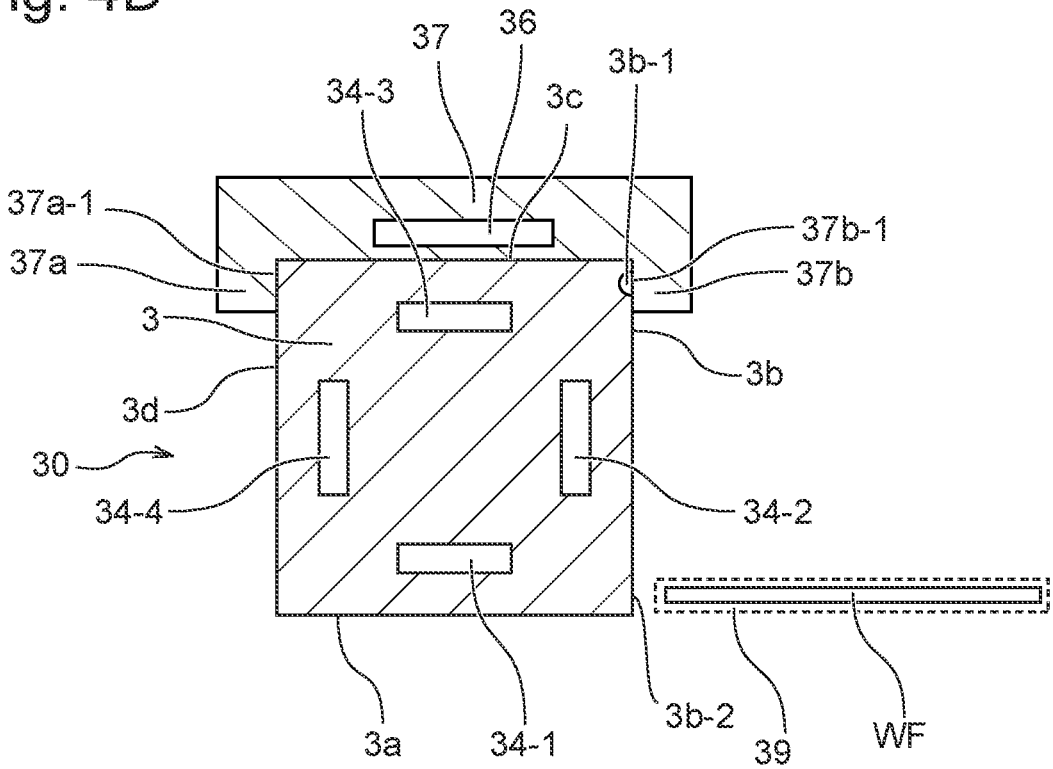
FIG. 4D is a cross-sectional view illustrating a fourth state where the retainer main body is secured to the retainer holding member.

FIG. 4D is a cross-sectional view illustrating the fourth state where the retainer main body is secured to the retainer holding member. The fourth state is a state where the retainer main body 3 is rotated such that the extending direction of the retainer main body 3 is switched in a vertical plane from the above-described first state to secure the retainer main body 3 to the retainer holding member 37. As illustrated in FIG. 4D, the retainer main body 3 includes the third surface 3*c* that is securable to the retainer holding member 37 and the second surface 3*b* opposed to the holding region 39 in the state where the third surface 3*c* is secured to the retainer holding member 37. In both the first state and the fourth state, the second surface 3*b* is opposed to the holding region 39. However, the opposed portion 3*b*-1 that has become worn in the first state is not opposed to the holding region 39 in the fourth state. The second surface 3*b* has an opposed portion 3*b*-2 opposed to the holding region 39 that is different from the opposed portion 3*b*-1 opposed to the holding region 39 in the first state. Since the opposed portion 3*b*-2 has not become worn, the retainer main body 3 can be continuously used.

Thus, the retainer main body 3 of this embodiment can be used eight times in total by rotating the retainer main body 3. Therefore, with this embodiment, the replacement frequency of the retainer 30 can be reduced.

The retainer main body 3 of this embodiment can be stably secured to the retainer holding member 37 regardless of the type of the polishing liquid. That is, to secure the retainer main body 3 to the retainer holding member 37, for example, making a screw hole in the retainer main body 3 to bolt the retainer main body 3 to the retainer holding member 37 can be considered. However, since the retainer main body 3 of this embodiment is rotated and used several times, it is necessary to make a screw hole in each of the first surface 3*a* to the fourth surface 3*d*. Accordingly, for example, when the first surface 3*a* is secured to the retainer holding member 37, the third surface 3*c* is opposed to the polishing pad 352 and in contact with the polishing liquid during polishing. As a result, the polishing liquid adheres to the screw hole in the third surface 3*c*, resulting in a risk that the third surface 3*c* cannot be secured to the retainer holding member 37.

In contrast, the retainer main body 3 of this embodiment is secured to the retainer holding member 37 using a magnetic force between a magnetic member embedded in the retainer main body 3 and the magnet 36 disposed in the retainer holding member 37. Accordingly, the retainer main body 3 can be stably secured to the retainer holding member 37 regardless of the type of the polishing liquid. An electromagnet can also be provided instead of the magnet 36. In this case, when the retainer main body 3 is attached to the retainer holding member 37, the electromagnet is energized to secure the retainer main body 3 to the retainer holding member 37, while the retainer main body 3 can be easily removed from the retainer holding member 37 by de-energizing the electromagnet when changing the orientation of the retainer main body 3. The means to secure the retainer main body 3 to the retainer holding member 37 is not limited to the one using the magnetic force. For example, when there is no risk of adhesion of the polishing liquid or the like, the retainer main body 3 may be secured to the retainer holding member 37 using a bolt or the like, or other means may be employed.

Figure 6A:
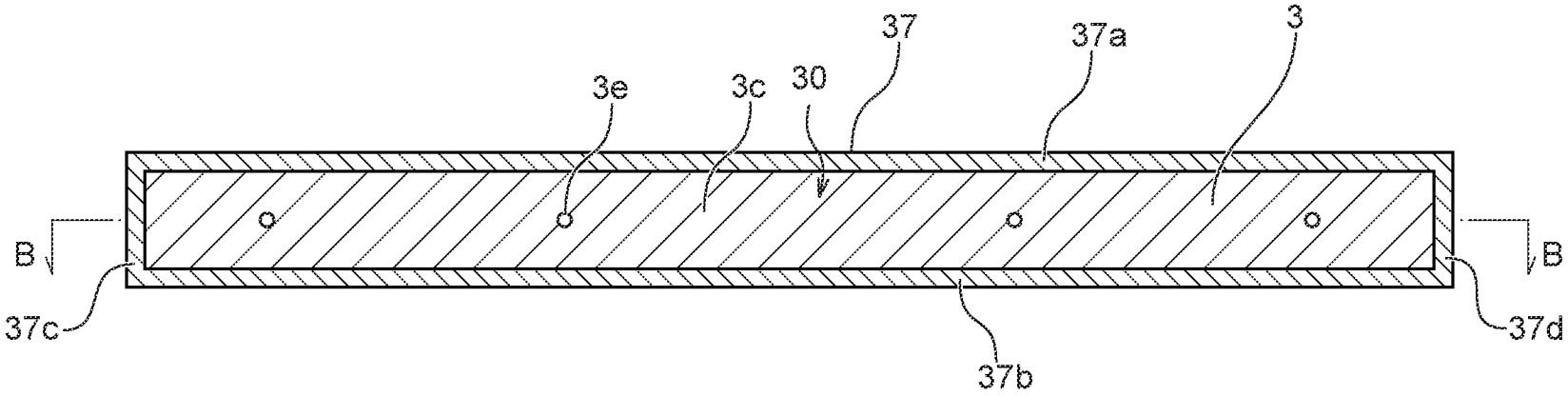
FIG. 6A is a bottom view of the retainer main body and the retainer holding member according to one embodiment.
Figure 6B:
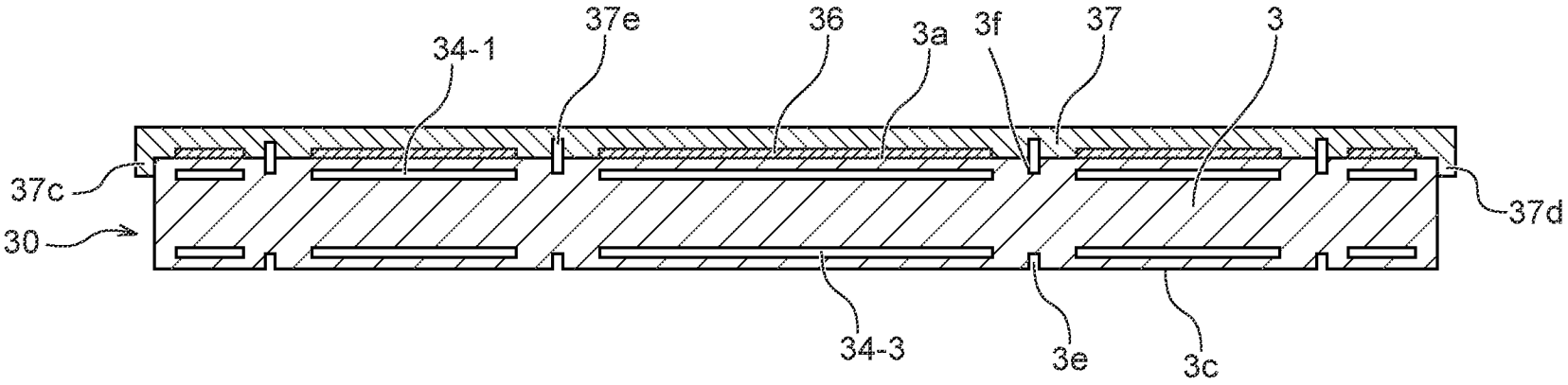
FIG. 6B is a cross-sectional view of the retainer main body and the retainer holding member taken along the line B-B in FIG. 6A.

Next, another embodiment of the retainer main body 3 and the retainer holding member 37 will be described. FIG. 6A is a bottom view of the retainer main body and the retainer holding member according to one embodiment. FIG. 6B is a cross-sectional view of the retainer main body and the retainer holding member taken along the line B-B in FIG. 6A.

The retainer main body 3 and the retainer holding member 37 of this embodiment have configurations similar to those of the embodiment illustrated in FIG. 4 and FIG. 5 except that a boss hole is formed in the retainer main body 3 and a boss is provided on the retainer holding member 37. Accordingly, overlapping description will be omitted.

As illustrated in FIG. 6A and FIG. 6B, a plurality of boss holes 3*e* are formed in the third surface 3*c* of the retainer main body 3 along the extending direction. As illustrated in FIG. 6B, a plurality of boss holes 3*f* are formed in the first surface 3*a* of the retainer main body 3 along the extending direction. Boss holes are similarly formed in the second surface 3*b* and the fourth surface 3*d* of the retainer main body 3. Meanwhile, as illustrated in FIG. 6B, the retainer holding member 37 is provided with a plurality of bosses 37*e* on the opposed surface opposed to the retainer main body 3. The plurality of bosses 37*e* are disposed at positions corresponding to the boss holes of the retainer main body 3.

With this embodiment, the retainer main body 3 can be attached to the retainer holding member 37 such that the bosses 37*e* are inserted into the boss holes 3*f* of the retainer main body 3, thus facilitating positioning of the retainer main body 3. By inserting the bosses 37*e* into the boss holes 3*f*, displacement of the retainer main body 3 during polishing can be suppressed. As illustrated in FIG. 6B, the plurality of boss holes 3*f* are formed at positions rotationally symmetrical about the center of the extending direction of the retainer main body 3. This enables the bosses 37*e* to be inserted into the boss holes 3*f* even when the retainer main body 3 is rotated by 180° such that the extending direction of the retainer main body 3 is switched, allowing the retainer main body 3 to be secured at the same position as before the rotation. The plurality of boss holes 3*e* and the plurality of boss holes formed in the second surface 3*b* and the fourth surface 3*d* of the retainer main body 3 are also formed at positions rotationally symmetrical about the center of the extending direction of the retainer main body 3.

Figure 7A:
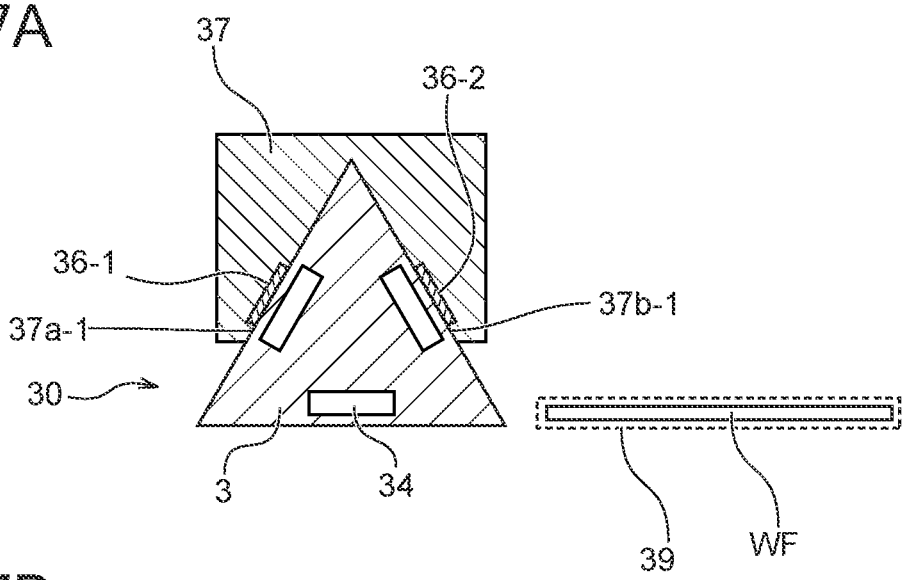
FIG. 7A is a cross-sectional view of a modification of the retainer main body and the retainer holding member.
Figure 7B:
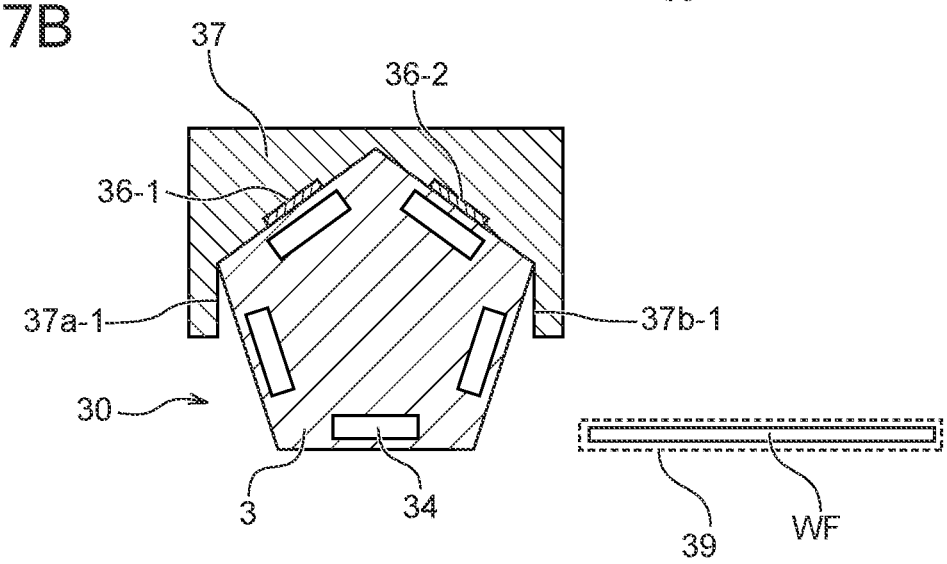
FIG. 7B is a cross-sectional view of a modification of the retainer main body and the retainer holding member.
Figure 7C:
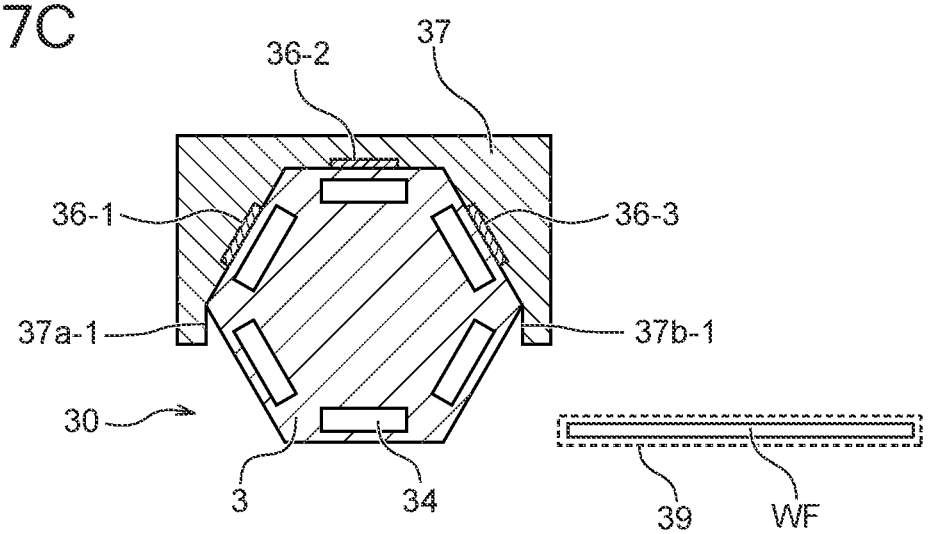
FIG. 7C is a cross-sectional view of a modification of the retainer main body and the retainer holding member.

In the above-described embodiment, while the retainer main body 3 having a square prism shape has been described as an example, the shape of the retainer main body 3 is not limited to this. FIG. 7A, FIG. 7B, and FIG. 7C are cross-sectional views illustrating modifications of the retainer main body and the retainer holding member.

As illustrated in FIG. 7A, the retainer main body 3 may have a regular triangular prism shape. In this case, a magnetic member 34 is embedded in each of the three side surfaces of the retainer main body 3. On the other hand, a depression corresponding to the shape of the retainer main body 3 is formed on the bottom surface of the retainer holding member 37. Magnets 36-1 and 36-2 are disposed on the opposed surfaces opposed to the retainer main body 3 of the retainer holding member 37. The retainer holding member 37 has the abutting surface 37*a*-1 and the abutting surface 37*b*-1. The abutting surface 37*a*-1 abuts on the retainer main body 3 for inhibiting the retainer main body 3 from displacing in the direction separating from the holding region 39 of the substrate. The abutting surface 37*b*-1 abuts on the retainer main body 3 for inhibiting the retainer main body 3 from displacing in the direction approaching the holding region 39 of the substrate.

As illustrated in FIG. 7B, the retainer main body 3 may have a regular pentagonal prism shape. In this case, the magnetic member 34 is embedded in each of the five side surfaces of the retainer main body 3. On the other hand, a depression corresponding to the shape of the retainer main body 3 is formed on the bottom surface of the retainer holding member 37. The magnets 36-1 and 36-2 are disposed on the opposed surfaces opposed to the retainer main body 3 of the retainer holding member 37. The retainer holding member 37 has the abutting surface 37*a*-1 and the abutting surface 37*b*-1. The abutting surface 37*a*-1 abuts on the retainer main body 3 for inhibiting the retainer main body 3 from displacing in the direction separating from the holding region 39 of the substrate. The abutting surface 37*b*-1 abuts on the retainer main body 3 for inhibiting the retainer main body 3 from displacing in the direction approaching the holding region 39 of the substrate.

As illustrated in FIG. 7C, the retainer main body 3 may have a regular hexagonal prism shape. In this case, the magnetic member 34 is embedded in each of the six side surfaces of the retainer main body 3. On the other hand, a depression corresponding to the shape of the retainer main body 3 is formed on the bottom surface of the retainer holding member 37. The magnets 36-1, 36-2, and a magnet 36-3 are disposed on the opposed surfaces opposed to the retainer main body 3 of the retainer holding member 37. The retainer holding member 37 has the abutting surface 37*a*-1 and the abutting surface 37*b*-1. The abutting surface 37*a*-1 abuts on the retainer main body 3 for inhibiting the retainer main body 3 from displacing in the direction separating from the holding region 39 of the substrate. The abutting surface 37*b*-1 abuts on the retainer main body 3 for inhibiting the retainer main body 3 from displacing in the direction approaching the holding region 39 of the substrate. The boss holes as shown in FIG. 6A and FIG. 6B may be formed in the retainer main body 3 of the modifications shown in FIG. 7A, FIG. 7B, and FIG. 7C, and the bosses as shown in FIG. 6A and FIG. 6B may be disposed on the retainer holding member 37 of the modifications shown in FIG. 7A, FIG. 7B, and FIG. 7C. The retainer main body 3 can have a regular polygonal prism shape without being limited to the above-described modifications. The shape of the retainer main body 3 is not limited to a regular polygonal prism. The retainer main body 3 may have various shapes such as a pillar shape having an L-shaped cross-sectional surface or the like.

Several embodiments of the present invention have been described above in order to facilitate understanding of the present invention without limiting the present invention. The present invention can be changed or improved without departing from the gist thereof, and obviously, the equivalents of the present invention are included in the present invention. It is possible to arbitrarily combine or omit respective constituent elements described in the claims and specification in a range in which at least a part of the above-described problems can be solved, or a range in which at least a part of the effects is exhibited.

As one embodiment, this application discloses a retainer for being disposed around a holding region of a polygonal substrate in a top ring configured to hold and press the polygonal substrate toward a polishing pad and for being pressed toward the polishing pad. The retainer includes a plurality of retainer main bodies disposed around the holding region independently along respective sides of the polygonal substrate. At least one of the plurality of retainer main bodies includes a first securing surface, a first opposed surface, a second securing surface, and a second opposed surface, the first securing surface being securable to a retainer holding member of the top ring, the first opposed surface being opposed to the holding region in a first state where the first securing surface is secured to the retainer holding member, the second securing surface being securable to the retainer holding member in a second state where the retainer main body is rotated from the first state, the second opposed surface being opposed to the holding region in a state where the second securing surface is secured to the retainer holding member.

Furthermore, as one embodiment, this application discloses a retainer as follows. The second state is a state where the retainer main body in the first state is rotated about a virtual rotation axis extending in an extending direction of the retainer main body, rotated such that the extending direction of the retainer main body is switched, or rotated in a combination thereof, and is different from the first state. The second opposed surface is a surface different from the first opposed surface or a surface that is same as the first opposed surface and has an opposed portion opposed to the holding region different from an opposed portion opposed to the holding region in the first state.

Furthermore, as one embodiment, this application discloses a retainer as follows. At least one of the plurality of retainer main bodies include a magnetic member embedded in the first securing surface to secure the first securing surface to the retainer holding member and a magnetic member embedded in the second securing surface to secure the second securing surface to the retainer holding member.

Furthermore, as one embodiment, this application discloses a retainer as follows. At least one of the plurality of retainer main bodies has a regular polygonal prism shape. The regular polygonal prism has side surfaces, and each of the side surfaces includes a magnetic member embedded in the side surface to secure the side surface to the retainer holding member.

Furthermore, as one embodiment, this application discloses a top ring for holding and pressing a polygonal substrate toward a polishing pad. The top ring includes a rotation shaft, a flange secured to the rotation shaft, a retainer holding member attached to the flange, and the retainer according to any one of them described above attached to the retainer holding member.

Furthermore, as one embodiment, this application discloses a top ring as follows. The retainer holding member includes a magnet or an electromagnet disposed on an opposed surface opposed to the retainer main body.

Furthermore, as one embodiment, this application discloses a top ring as follows. The retainer holding member has an abutting surface abutting on the retainer main body for inhibiting the retainer main body from displacing in a direction separating from the holding region.

Furthermore, as one embodiment, this application discloses a top ring as follows. The first securing surface and the second securing surface of the retainer main body have a plurality of boss holes formed along an extending direction of the retainer main body. The retainer holding member has an opposed surface opposed to the retainer main body, and the opposed surface includes a plurality of bosses disposed at positions corresponding to the boss holes of the first securing surface and the second securing surface of the retainer main body.

Furthermore, as one embodiment, this application discloses a substrate processing apparatus as follows. The plurality of boss holes are formed at positions rotationally symmetrical about a center of the extending direction of the retainer main body.

Furthermore, as one embodiment, this application discloses a substrate processing apparatus. The substrate processing apparatus includes the top ring according to any one of them described above, and a polishing table configured to hold the polishing pad.

REFERENCE SIGNS LIST

3 . . . retainer main body
3*a* . . . first surface
3*b* . . . second surface
3*c* . . . third surface
3*d* . . . fourth surface
3*e* . . . boss hole
3*f* . . . boss hole
17 . . . flange
18 . . . top ring shaft
30 . . . retainer
34 . . . magnetic member
36 . . . magnet
37 . . . retainer holding member
37*a* . . . side wall
37*a*-1 . . . abutting surface
37*b* . . . side wall
37*b*-1 . . . abutting surface
37*e* . . . boss
39 . . . holding region
300 . . . polishing unit
302 . . . top ring
350 . . . polishing table
352 . . . polishing pad
1000 . . . substrate processing apparatus
WF . . . substrate

The invention claimed is:

1. A retainer for being disposed around a holding region of a polygonal substrate in a top ring configured to hold and press the polygonal substrate toward a polishing pad and for being pressed toward the polishing pad, the retainer comprising:

a plurality of retainer main bodies disposed around the holding region independently along respective sides of the polygonal substrate, wherein at least one of the plurality of retainer main bodies includes a first securing surface, a first opposed surface, a second securing surface, and a second opposed surface, the first securing surface being securable to a retainer holding member of the top ring, the first opposed surface being opposed to the holding region in a first state where the first securing surface is secured to the retainer holding member, the second securing surface being securable to the retainer holding member in a second state where the retainer main body is rotated from the first state, the second opposed surface being opposed to the holding region in a state where the second securing surface is secured to the retainer holding member.

2. The retainer according to claim 1, wherein the second state is a state where the retainer main body in the first state is rotated about a virtual rotation axis extending in an extending direction of the retainer main body, rotated such that the extending direction of the retainer main body is switched, or rotated in a combination thereof, and is different from the first state, and the second opposed surface is a surface that is same as the first opposed surface, such that in the second state, an opposed portion of the second opposed surface is opposed to the holding region different from an opposed portion opposed to the holding region in the first state.

3. The retainer according to claim 1, wherein at least one of the plurality of retainer main bodies include a first magnetic member embedded in the first securing surface to secure the first securing surface to the retainer holding member and a second magnetic member embedded in the second securing surface to secure the second securing surface to the retainer holding member.

4. The retainer according to any one of claim 1, wherein at least one of the plurality of retainer main bodies has a regular polygonal prism shape, and the regular polygonal prism has side surfaces, and each of the side surfaces includes a magnetic member embedded in the side surface to secure the side surface to the retainer holding member.

5. A top ring for holding and pressing a polygonal substrate toward a polishing pad, comprising:

a rotation shaft;

a flange secured to the rotation shaft;

the retainer holding member attached to the flange; and the retainer according to claim 1 attached to the retainer holding member.

6. The top ring according to claim 5, wherein the retainer holding member includes a magnet or an electromagnet disposed on an opposed surface opposed to the retainer main body.

7. The top ring according to claim 5, wherein the retainer holding member has an abutting surface abutting on the retainer main body for inhibiting the retainer main body from displacing in a direction separating from the holding region.

8. The top ring according to any one of claim 5, wherein the first securing surface and the second securing surface of the retainer main body have a plurality of boss holes formed along an extending direction of the retainer main body, and the retainer holding member has an opposed surface opposed to the retainer main body, and the opposed surface includes a plurality of bosses disposed at positions corresponding to the boss holes of the first securing surface and the second securing surface of the retainer main body.

9. The top ring according to claim 8, wherein the plurality of boss holes are formed at positions rotationally symmetrical about a center of the extending direction of the retainer main body.

10. A substrate processing apparatus comprising:

the top ring according to any one of claim 5; and a polishing table configured to hold the polishing pad.

11. The retainer according to claim 1, wherein the second state is a state where the retainer main body in the first state is rotated about a virtual rotation axis extending in an extending direction of the retainer main body, rotated such that the extending direction of the retainer main body is switched, or rotated in a combination thereof, and is different from the first state, and the second opposed surface is a surface different from the first opposed surface.

* * * * *